US009739177B2

(12) United States Patent
Schaefer et al.

(10) Patent No.: US 9,739,177 B2
(45) Date of Patent: Aug. 22, 2017

(54) ROTARY FLOW MACHINE AND METHOD FOR DISASSEMBLING THE SAME

(71) Applicant: ALSTOM Technology Ltd, Baden (CH)

(72) Inventors: Martin Schaefer, Gebenstorf (CH); Marc Rauch, Frenkendorf (CH); Tobias Steffen, Bellikon (CH); Daniel Seng, Wettingen (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 718 days.

(21) Appl. No.: 14/191,839

(22) Filed: Feb. 27, 2014

(65) Prior Publication Data

US 2014/0241876 A1 Aug. 28, 2014

(30) Foreign Application Priority Data

Feb. 27, 2013 (EP) ..... 13156973

(51) Int. Cl.
*F01D 25/28* (2006.01)
*F01D 25/24* (2006.01)

(52) U.S. Cl.
CPC ..... *F01D 25/28* (2013.01); *F01D 25/246* (2013.01); *Y10T 29/49318* (2015.01)

(58) Field of Classification Search
CPC ..... F01D 25/265; F01D 25/246; F01D 25/28; F01D 25/26
See application file for complete search history.

(56) References Cited

U.S. PATENT DOCUMENTS 1,791,657 A 2/1931 Brown
3,408,045 A 10/1968 Hart
(Continued)

FOREIGN PATENT DOCUMENTS

AT 76744 6/1919
EP 2 375 007 10/2011
(Continued)

OTHER PUBLICATIONS

Office Action (Notice of Preliminary Rejection) issued on Sep. 8, 2015, by the Korean Patent Office in corresponding Korean Patent Application No. 10-2014-0022387, and an English Translation of the Office Action (12 pages).
(Continued)

*Primary Examiner* — Justin Seabe
(74) *Attorney, Agent, or Firm* — Buchanan Ingersoll & Rooney PC

(57) ABSTRACT

The invention refers to a rotary flow machine having a rotor unit, rotating about a rotational axis, around which in at least one partial axial area a stationary inner housing (IH) is provided at a radial distance. The stationary inner housing (IH) can be divided up along the rotational axis in an upper and a lower inner housing half which adjoin each other along a horizontal split plane. The inner housing (IH) is surrounded in at least one axial section by an outer housing (OH) which can be divided up along the rotational axis in one upper and one lower outer housing half. Further a method for disassembling of a rotary flow machine is disclosed. The lower inner housing half provides support means which support the inner lower housing half on the lower outer housing half. The support means are detachably mounted at the lower inner housing half at least at two opposite support positions (P1, P2) relative to the rotational axis along the split plane.

14 Claims, 2 Drawing Sheets

(56) References Cited

U.S. PATENT DOCUMENTS

| | | | | |
|---|---|---|---|---|
| 3,592,557 | A | 7/1971 | Haas et al. | |
| 3,754,833 | A * | 8/1973 | Remberg | F01D 25/265 415/108 |
| 4,925,363 | A | 5/1990 | Brown et al. | |
| 7,581,922 | B1 | 9/2009 | Morimoto et al. | |
| 7,686,575 | B2 | 3/2010 | Chehab et al. | |
| 8,276,273 | B2 * | 10/2012 | Shigemoto | F01D 25/26 29/402.03 |
| 8,905,712 | B2 | 12/2014 | Burdgick et al. | |
| 2008/0317591 | A1 | 12/2008 | Golinkin et al. | |
| 2010/0031671 | A1 | 2/2010 | Chehab et al. | |
| 2011/0250063 | A1 | 10/2011 | Burdgick et al. | |

FOREIGN PATENT DOCUMENTS

| | | |
|---|---|---|
| EP | 2 551 473 | 1/2013 |
| JP | 63-170505 | 7/1988 |
| JP | 2011-220332 A | 11/2011 |
| RU | 2 166 101 C2 | 4/2001 |
| WO | 2006/103152 | 10/2006 |
| WO | 2008/012195 | 1/2008 |
| WO | 2011/026516 | 3/2011 |

OTHER PUBLICATIONS

Office Action (Decision of Grant a Patent for Invention) issued on Sep. 29, 2015, by the Russian Patent Office in corresponding Russian Patent Application No. 2014107400/06(011676), and an English Translation of the Office Action. (12 pages).

* cited by examiner

ROTARY FLOW MACHINE AND METHOD FOR DISASSEMBLING THE SAME

CROSS-REFERENCE TO RELATED APPLICATIONS

This application claims priority to European application 13156973.3 filed Feb. 27, 2013, the contents of which are hereby incorporated in its entirety.

TECHNICAL FIELD

The present invention relates to a rotary flow machine comprising a rotor unit, rotating about a rotational axis, around which in at least one partial axial area a stationary inner housing is provided at a radial distance which can be divided up along the rotational axis in an upper and a lower inner housing half which adjoin each other along a horizontal split plane, said inner housing is surrounded in at least one axial section by an outer housing which can be divided up along the rotational axis in one upper and one lower outer housing half. Further, the invention relates to a method for disassembling a rotary flow machine of the before art.

BACKGROUND

Performing maintenance work on rotary flow machines is a time and cost consuming operation due to the multitude of components which has to be disassembled to get free access to the inner parts of the rotary flow machine. Especially in case of gas or steam turbines the rotating and static components being arranged within the gas flow path are directly exposed to hot gas flow by which degradation effects are unavoidable so that maintenance work has to be performed in periodic time intervals.

In general, rotary flow machines of the before mentioned art are typically provided with an inner housing that contains rows of vanes for directing hot gas flow passed the blades mounted on the rotor unit. Such conventional inner housing is disposed within an outer housing for well-known reasons.

For performing maintenance work on such well-known rotary flow machines the inner and outer housing are divided into an upper and a lower housing half that are removable joint to each other. In a similar manner, the vane rows are also divided into upper and lower semi-circular halves so that they may be removed with the associated inner casing half as a unit, and then subsequently removed from the casing for repair or replacement work.

To facilitate maintenance work on such kind of rotary flow machines it is a well known technique to lift off first the upper halves of the outer and inner casing and to rotate the inner casing together with the rows of vanes about its rotational axis to an upper most position in which it is free of the rotor, at which time it may be readily lifted clear of the lower half of the outer casing for repairs or replacement. Such techniques of maintenance works on rotary flow machines are disclosed for example in U.S. Pat. No. 4,925,363, WO 2008/012195 A1 or WO 2006/103152 A1.

In all known cases it is necessary to insert additional means for supporting the lower inner housing half towards the lower outer housing half for avoiding any damage causing contact while the lower inner housing half will be rotated around the rotational axis into an upper position. So it is a common used technique to insert sliding or rolling bodies between the lower inner and outer casing halves to enable rotation of the lower inner housing half with constant distance from the lower outer housing half. An alternative technique is to insert connection means between the lower inner housing half and the rotor unit which connect the lower inner housing half torque proof to the rotor unit.

A further disadvantage of all known joints between the lower and upper inner housing halves is the fact that all known mounting means in order to support the inner housing to the outer housing do not allow a thermal expansion of the inner housing free of eccentricity, i.e. thermal expansion affects differently on the upper and lower inner housing halves due to mounting arrangements between the inner and outer housing which are arranged adjacent to the split plane which corresponds to the contact plane between the upper and lower inner housing halves.

The document U.S. Pat. No. 7,686,575 discloses a gas turbine with an outer casing and an inner casing with independent thermal expansion of flow path components. The inner casing comprises a first and a second half, the outer casing comprises a first and a second half, the inner casing being mounted within the outer casing on four radially slidable mounts there between, being positioned 90° apart, comprising first and second keys, that are bolted into respective first and second joints between the first and the second half of the inner casing, the first and second keys received in respective first and second slots in respective first and second joints between the first and second halves of the outer casing, each slot being formed as an enclosed chamber except for an open radially inner end thereof that receives the respective key and allows only radial motion of the key.

Another embodiment of a gas turbine that allows relative thermal growth between the inner casing and the outer casing is disclosed in patent application US 2008/0317591.

Another disadvantage of the joints according to the state of the art is that the inner casing is not movable before the upper part of the outer casing has been removed.

SUMMARY

It is a general object to the present invention to provide a rotary flow machine as well as a method for disassembling the same which facilitate maintenance work on rotary flow machines without the need of sliding or rolling elements to support the lower inner housing half on said lower outer housing half. It is a further aspect of the invention to reduce or avoid completely any eccentricity due to thermal expansion especially within the inner housing when the rotary flow machine is in operation. Disassembling steps concerning the outer and inner casing of the rotary flow machine shall be possible without the need of demounting or replacing the rotor unit.

These objects are achieved by the rotary turbine engine given in claim 1. The invention can be modified advantageously by the features disclosed in the dependent claims as well in the following description especially referring to a preferred embodiment. Further an inventive method for disassembling a rotary flow machine given in one of the claims 1 to 8 is disclosed in claims 9 to 10.

The basic idea of the invention can be applied to rotary flow machines of any kind, preferably to a gas or steam turbine. Also it is possible to apply the inventive idea on a compressor unit which provides an inner and outer casing. The following description is directed to a gas turbine without limitation the general inventive idea of such kind of rotary flow machine.

The inventive idea concerns a rotary flow machine comprising a rotor unit, rotating about a rotational axis, around which in at least one partial axial area a stationary inner housing is provided at a radial distance which can be divided up along the rotational axis in an upper and a lower inner housing half which adjoin each other along a horizontal split plane, said inner housing is surrounded in at least one axial section by an outer housing which can be divided up along the rotational axis in one upper and one lower outer housing half, the lower inner housing half provides support means which support the lower inner housing half on the lower outer housing half and said support means are detachably mounted at the lower inner housing half at least at two opposite support positions relative to the rotational axis along the split plane, said rotary flow machine is characterized in that the lower and upper inner housing half each provides a recess at the support positions which complement to a single recess in a closed state of the inner housing and said single recess is in shape of a blind hole being open in radially outward direction and formed closed against the rotor unit, and said single recess in the inner housing at each support position surrounds the mounting section of the support means.

The lower and upper inner housing half each provides a recess at the support position which complements to a single recess in a closed state of the inner housing which is in shape of a blind hole being open in radially outward direction and formed closed against the rotor unit. Shape and size of the single recess inside the inner housing at each support position correspond to the outer contour of the mounting section of the support means, i.e. the single recess in the housing at each support position surrounds this mounting section in the support means in a flush manner preferably. So the mounting section of the support means is fixed tightly inside the single recess, for example by using bold connections, while the carrier section of the support means protrudes the inner housing radially outward.

Due to the detachably mounted support means at the lower inner housing half it is possible to lift off the upper inner housing half while the lower inner housing half remains in position due to the inventive support on the lower outer housing half at least at the two support positions opposite relative to the rotational axis along the split plane.

In a preferred embodiment the support means at each support position is realized as a bar-shaped element having a mounting and a carrier section being joint in one piece, wherein the mounting section of the bar-shaped element is inserted at least partially into a recess of the lower inner housing half, in which the mounting section of the bar-shaped element is detachably mounted by fixing means, preferably by bolted connection. The carrier section of the bar-shaped element extends beyond the recess of the lower inner housing half in radially outward direction and ends up in the space of a recess of at least the lower outer housing half, in which the carrier section contacts at least one support surface of the lower outer housing half directly or indirectly on which the carrier section of the bar-shaped element rests slidably at least in radial direction. Preferably the support surface of the lower outer housing half lies in circumferential direction of the inner housing lower to the split plane so that it is possible to adjust the carrier section of the bar-shaped element such that the carrier section is centered along the split plane, i.e. the split plane passes through the carrier section of the support means along its midplane, so that excentricity due to thermal expansion of the upper and lower inner housing halves can be reduced significantly.

For centering purposes of the carrier section of each support means relative to the split plane a number of constructive arrangements have been taken. According to a preferred embodiment the lower and upper outer housing halves each provides a recess at the support positions which complement to a single recess in a closed state of the outer housing, providing an upper periphery of the upper outer housing half and also a lower periphery of the lower housing half in circumferential direction enclosing a circumferential distance which is greater than the dimension of the carrier section in a corresponding circumferential direction. So the carrier section of the support means extends radially outward into the space of the single recess of the outer housing at each support position such that the carrier section of the support means encloses an upper gap with the upper periphery and a lower gap with the lower periphery. Both gaps enable insertion of adjustment devices to adjust exactly, fast and easily the support means relative to the split plane. As it will be described in more detail in connection with the embodiment shown in the figures adjustment devices can be inserted into the gaps from outside of the closed engine, i.e. the outer housing provides an access opening at each support position through which radial access to the before described gaps is possible for inserting the adjustment devices in radial direction. Each adjustment device comprises at least two parts, a carrier part which can be detachably fixed to the lower respectively upper outer housing half and which provides mounting means for holding at least one shim. The number and thickness of the shims, which are mounted on the carrier device, determine the total thickness of each adjustment device, which in turn determine the position of the support means relative to the split plane. The adjustment device which is radially insertable into the lower gap is designated as support element and supports the carrier section of the support means on the support surface which is the lower periphery of the lower outer housing half. The adjustment device which is insertable radially into the upper gap is designated as downholder element, which presses the carrier section in circumferential direction from above towards the split plane. The number and/or thickness of the at least one shim carried by the support element and the number and/or thickness of the at least one shim carried by the downholder element are chosen such that said carrier section of the support means is centred along the split plane, i.e. the split plane passes through the carrier section of the support means along its midplane. Since the at least two support means, which are positioned at opposite support positions relative to the rotational axis, being identical in shape and size, the inner housing, i.e. the upper and lower inner housing halves, can expand equally in radial direction due to thermal expansion while the rotary flow machine is in operation, so that no excentricity and no mechanical stresses will occur inside the inner housing.

The inventive idea of supporting the lower inner housing half on the lower outer housing half along the split plane of the inner and outer housing of a rotary flow machine leads to a further aspect of the invention concerning an easier disassembly of a rotary flow machine.

A method for disassembling a rotary flow machine, as described before, is characterized by the following steps: In a first step the upper outer housing half will be removed by releasing all connection means between the upper and lower outer housing halves so that lifting off in vertical direction of the upper outer housing half from the lower outer housing half will be possible. Thereafter, the upper inner housing half will be removed by releasing all connection means between the upper and lower inner housing halves, so that lifting off in vertical direction the upper inner housing half from the lower inner housing half will be possible while the lower inner housing half being supported by the lower outer housing half exclusively. It has to note that there is no need to use any additional supporting or fixing means to keep the lower inner housing half in position for avoiding any damage causing contact between the lower inner and lower outer housing half.

In case of further disassembling purpose it will be necessary to insert a support member between the lower outer and lower inner housing half and/or insert a carrying member between the lower inner housing half and the rotor unit. Afterwards the support means at the support positions between the lower inner housing half and the lower outer housing half has to be removed. Hereto fixing means for fixing the support means being inserted and fixed into a recess of the inner lower housing half have to be released and removed out of the recess of the inner lower housing half. Finally it is possible to rotate the lower inner housing half around the rotational axis till the lower inner housing half is able for lifting off vertically.

BRIEF DESCRIPTION OF THE FIGURES

The invention shall subsequently be explained in more detail based on exemplary embodiment in conjunction with the drawings. The drawings

DETAILED DESCRIPTION

Figure 1A:
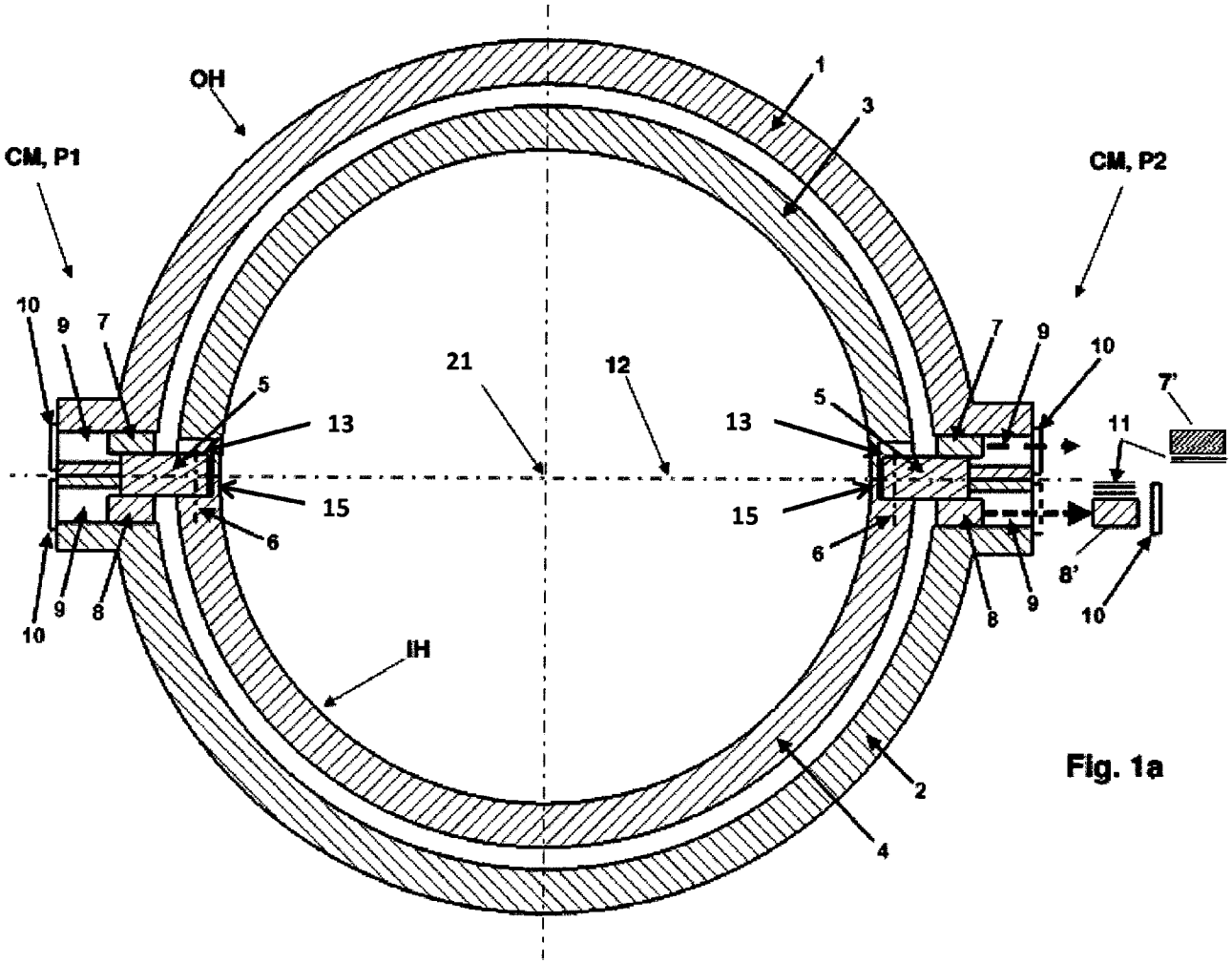
FIG. 1*a* shows a cross sectional view through a rotary flow machine having an inner and an outer housing and FIG. 1*b* shows an enlarged view of a support position, shown in FIG. 1*a*.

FIG. 1*a* shows a cross sectional view through a rotary flow machine providing a stationary inner housing IH which can be divided up along the rotational axis 21 in an upper inner housing half 3 and a lower inner housing half 4 which adjoin each other along a horizontal split plane 12. At a radial distance the inner housing IH is surrounded by an outer housing OH which can be also divided up along the rotational axis 21 in an upper outer housing half 1 and a lower outer housing half 2.

The cross sectional view shown in FIG. 1*a* illustrates a cutting plane which traverses the connection mechanism CM between the inner housing IH and outer housing OH which is located at two opposite support positions P1, P2 relative to the rotational axis 21 along the split plane 12 and which is of axially limited extension so that the upper inner housing half 3 and the lower inner housing half 4 join each other directly along the split plane 12 in the remaining axial extension. The same applies to the upper outer casing half 1 and the lower outer casing half 2.

Figure 1B:
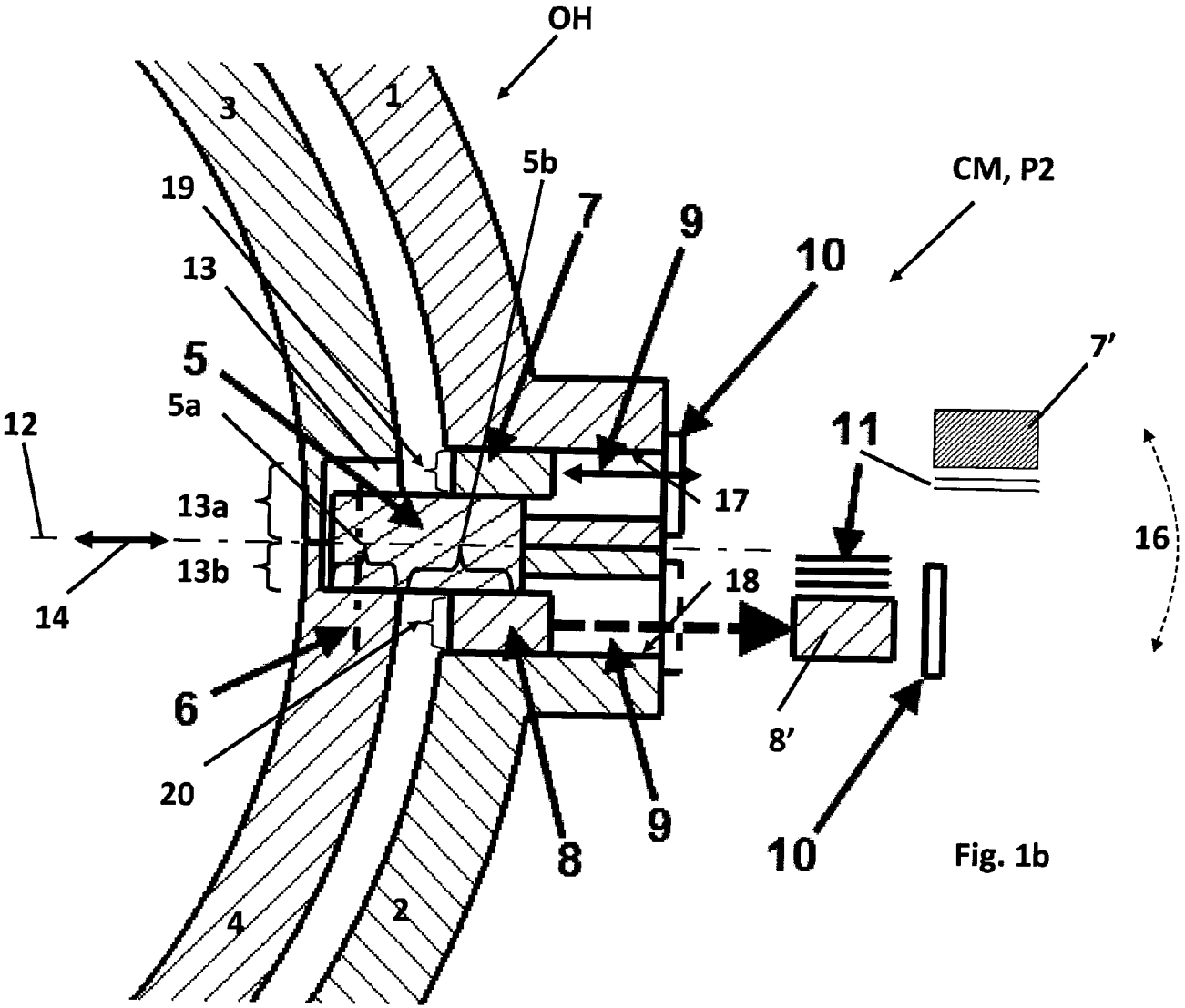

For a detailed description of at least two connection mechanisms CM which are identical, it will be further referred to FIG. 1*b*, which shows an enlarged view of the connection mechanism CM. At the support positions P1, P2 the upper and lower inner housing halves 3, 4 each provides a recess 13*a*, 13*b* at the support position (P2 shown in FIG. 1*b*) which complements to a single recess 13 in a closed state of the inner housing IH. The single recess 13 has the shape of a blind hole and is open in radially direction which is illustrated by arrow 14 and formed closed against the rotor unit which is not illustrated in FIG. 1*b*, which however is enclosed by the upper and lower inner housing half 3, 4. In the enlarged view of FIG. 1*b* the inner wall sections 15 ensure that there is no access from the region of the single recess 13 to the inside of the rotor unit.

For performing maintenance work on the rotary flow machine at first the upper outer casing half 1 and afterwards the upper inner casing half 3 have to be removed by lifting off each housing half separately. For preventing that the lower inner housing half 4 drops down and get in damage causing contact with the lower outer housing half 2 it is inventively proposed to provide a support means 5 for supporting the lower inner housing half 4 on the lower outer housing half 2. The support means 5 is detachably mounted for example by a bolted connection 6 in the recess of the lower inner housing half 4.

The support means 5 preferably is a bar-shaped element having preferably a rectangular cross section in radial direction 14 which can be divided into a mounting section 5*a* which is in direct contact with the recess of the lower inner housing half 4, and a carrier section 5*b* which protrudes the lower inner housing half 4 radially outward and ends up in the space of a recess 9 within the upper and lower outer housing halves 1, 2 which form a so called access hole in a closed state of the outer housing OH which also enables free access from radially outside of the outer housing OH to the support means 5 as well other components inside the access hole 9 as will be described later. The access hole 9 is bordered at least in a circumferential direction which is indicated by arrow 16 by an upper periphery 17 of the upper outer housing half 1 and by a lower periphery 18 of the lower outer housing half 2. A carrier section 5*b* of the support means 5 extends radially outward into the space of the access hole 9 such that the carrier section 5*b* encloses an upper gap 19 with the periphery 17 of the upper outer housing half 1 and a lower gap 20 with the periphery 18 of the lower outer housing half 2. For centering purpose of the carrier section 5*b*, i.e. of the support means 5, relatively to the split plane 12 in each of the gaps 19, 20 adjustment devices 7, 8 are provided which can be inserted from outside through the axis hole 9 by radial movement only.

The lower adjustment device 8 comprises a support element 8' which carries at least one shim 11 which is insertable and removable in radially direction in or out of the space of the lower gap 20. The support element 8' is detachably mounted, for example by a bolted connection with the lower outer housing half 2 within the axis hole 9.

In the same way the upper adjustment device 7 consists of a so called down holder element 7' to which also at least one shim is attachable. The package of the down holder element 7' and that at least one shim 11 is also insertable and removable in radial direction in or out of the space of the upper gap 19. Also the down holder element 7' is detachably fixed at the upper outer housing half 1 inside the access hole 9.

The number and/or thickness of the at least one shim 11 carried by the support element 8' as well by the down holder element 7' are chosen such that the carrier section 5*b* of the support means 5 is centered along the split plane 12, i. e. the split plane 12 passes through the center of the carrier section 5*a* of the support means 5.

Further, the bar shaped element 5, which is in case of the embodiment shown in FIG. 1*a, b* of rectangular shape, is slidably mounted between the two adjustment devices 7, 8. In case of operation due to thermal expansion the upper and lower inner housing halves 3, 4 will enlarge radially. Since the bar shaped supporting means 5 at both support positions P1, P2 are able to slide in radial outward direction no thermal stresses can occur inside the inner housing. Due to a centered alignment of the support means 5 relative to the split plane 12 excentricity of the inner housing IH in the course of thermal expansion can be reduced significantly.

All work in connection with adjustment of the support means 5 relative to the split plane 12 can be performed from outside at a closed engine through the axis hole 9 by inserting radially the adjustment devices 7, 8 each providing a suitable height of stacked shims 11 to reach a predefined position of the support means 5 relative to the split plane 12.

The direct access from outside is placed in a way that nothing can fall into the inside of the machine because the recess 13 of the inner housing IH does not allow any direct access to the inner of the rotary machine.

Finally the open axis hole 9 can be covered by cover plates 10 which are also detachably mounted to the outer housing OH.

The inventive rotary turbo machine enables an easy and fast disassembling of important components of the rotary turbine engine without the need of removal of the rotor unit. In a first step the upper outer housing half 1 will be removed after releasing all connection means between the upper and lower outer housing halves 1, 2 by lifting off in vertical direction the upper outer housing half 1 from the lower outer housing half 2. Thereafter the upper inner housing half 3 is removed by releasing all connection means between the upper and lower inner housing halves 3, 4 by lifting off in vertical direction the upper inner housing half 3 from the lower outer housing half 4 while the lower inner housing half 4 remains in position since the lower inner housing half 4 is supported by the lower outer housing half 2 exclusively as described before.

Even in case of further disassembling purpose support members (not shown) have to be inserted between the lower outer and lower inner housing half 4, 2 and/or a carrying member has to be inserted between the lower inner housing half 4 and the rotor unit. In a further step the support means 5 at the support positions P1, P2 between the lower inner housing half 4 and the lower outer housing half 2 have to be released so that the lower inner housing half 4 can be rotated around the rotational axis 13 till the lower inner housing half 4 is able for lifting off vertically.

For releasing the support means 5 the fixing means 6 for fixing the support means 5 have to be released so that the support means 5 can be removed out of the recess 13 of the inner lower housing half 4.

For assembling purposes the steps described before can be performed in reverse order.

After having closed the outer housing the adjustment elements 7, 8 have to be inserted radially into the gaps 19, 20 as described before to ensure a precise vertical position of the support means 5 relative to the split plane 12 to ensure reduction of excentricity of the inner housing due to thermal expansion during operation of the rotary flow machine.

The invention claimed is:

1. A rotary flow machine comprising:

a rotor unit, rotating around a rotational axis, around which in at least one partial axial area a stationary inner housing is provided at a radial distance which can be divided up along the rotational axis in an upper and a lower inner housing half which adjoin each other along a horizontal split plane, said inner housing is surrounded in at least one axial section by an outer housing which can be divided along the rotational axis in one upper and one lower outer housing half, and the lower inner housing half having a support, which supports the inner lower housing half on the lower outer housing half, and said support is detachably mounted at the lower inner housing half at least at two opposite support positions relative to the rotational axis along the split plane, wherein the lower and upper inner housing half each provides a recess at the support positions which complement to form a single recess in a closed state of the inner housing and said single recess is in a shape of a blind hole being open in a radially outward direction and formed closed against the rotor unit, and said single recess in the inner housing at each support position surrounds a mounting section of the support, wherein the support includes the mounting section and a carrier section, said mounting section is in contact with the lower inner housing half and detachably mounted to said lower inner housing, and said carrier section protrudes from the lower inner housing half radially outward and ends in a recess of the outer housing half, in which the carrier section rests slidably in a radial direction, and wherein said recess is formed as an access hole to enable access from radially outside of the outer housing, is bordered by an upper periphery of the upper outer housing half and by a lower periphery of the lower outer housing half, and said carrier section of the support extends radially outward into the recess of the outer housing at each support position such that the carrier section of the support encloses an upper gap with the upper periphery and a lower gap with the lower periphery, and wherein adjustment devices are placed into the lower and upper gap for the purposes of centering the carrier section of the support in a circumferential direction of the outer housing.

2. The rotary flow machine according to claim 1, wherein the support is a bar-shaped element.

3. The rotary flow machine according to claim 1, further comprising:

at least one shim, the at least one shim configured to be insertable and removable in radial direction in or out of the lower gap and the upper gap, and wherein the at least one shim is located between the adjustment devices and the support.

4. The rotary flow machine according to claim 1, wherein the lower periphery of the lower outer housing half, which corresponds to the support surface of the lower outer housing half, is in the circumferential direction below the split plane.

5. The rotary flow machine according to claim 3, wherein a number and/or a thickness of the at least one shim are chosen such that said carrier section of the support is centered along the split plane.

6. The rotary flow machine according to claim 1, wherein the rotary flow machine is a gas turbine or a steam-turbine or a compressor unit.

7. A method for disassembling a rotary flow machine, the rotary flow machine includes a rotor unit, rotating around a rotational axis, around which in at least one partial axial area a stationary inner housing is provided at a radial distance which can be divided up along the rotational axis in an upper and a lower inner housing half which adjoin each other along a horizontal split plane, said inner housing is surrounded in at least one axial section by an outer housing which can be divided along the rotational axis in one upper and one lower outer housing half, and the lower inner housing half having a support, which supports the inner lower housing half on the lower outer housing half, and said support is detachably mounted at the lower inner housing half at least at two opposite support positions relative to the rotational axis along the split plane, wherein the lower and upper inner housing half each provides a recess at the support positions which complement to form a single recess in a closed state of the inner housing and said single recess is in a shape of a blind hole being open in a radially outward direction and formed closed against the rotor unit, and said single recess in the inner housing at each support position surrounds a mounting section of the support, wherein the support includes the mounting section and a carrier section, said mounting section is in contact with the lower inner housing half and detachably mounted to said lower inner housing, and said carrier section protrudes from the lower inner housing half radially outward and ends in a recess of the outer housing half, in which the carrier section rests slidably in a radial direction, and wherein said recess is formed as an access hole to enable access from radially outside of the outer housing, is bordered by an upper periphery of the upper outer housing half and by a lower periphery of the lower outer housing half, and said carrier section of the support extends radially outward into the recess of the outer housing at each support position such that the carrier section of the support encloses an upper gap with the upper periphery and a lower gap with the lower periphery, and wherein adjustment devices are placed into the lower and upper gap for the purposes of centering the carrier section of the support in a circumferential direction of the outer housing, the method comprising:

removing the upper outer housing half by lifting off in a vertical direction the upper outer housing half from the lower outer housing half, and removing the upper inner housing half by lifting off in a vertical direction the upper inner housing half from the lower inner housing half while the lower inner housing half being supported by the lower outer housing half exclusively.

8. The method according to claim 7, comprising:

releasing the support at the support positions between the lower inner housing half and the lower outer housing half, and rotating the lower inner housing half around the rotational axis until the lower inner housing half is able to be lifted vertically.

9. The rotary flow machine according to claim 5, wherein the split plane passes through the carrier section of the support.

10. The method according to claim 7, wherein the support is a bar-shaped element.

11. The method according to claim 7, comprising:

inserting at least one shim in radial direction in or out of the lower gap and the upper gap, and detachably fixing the adjustment devices at the lower outer housing half and at the upper outer housing half.

12. The method according to claim 7, wherein the lower periphery of the lower outer housing half, which corresponds to the support surface of the lower outer housing half, is in the circumferential direction below the split plane.

13. The method according to claim 11, comprising:

choosing a number and/or a thickness of the at least one such that said carrier section of the support is centered along the split plane.

14. The method according to claim 7, wherein the rotary flow machine is a gas turbine or a steam-turbine or a compressor unit.

* * * * *